US008047278B2

(12) United States Patent
Swietlik et al.

(10) Patent No.: US 8,047,278 B2
(45) Date of Patent: Nov. 1, 2011

(54) HYDRAULIC CONNECTOR APPARATUSES AND METHODS OF USE WITH DOWNHOLE TUBULARS

(75) Inventors: George Swietlik, Lowestoft (GB); Burney J. Latiolais, Jr., Lafayette, LA (US); Robert Large, Lowestoft (GB)

(73) Assignee: Pilot Drilling Control Limited, Lowestoft (GB)

( * ) Notice: Subject to any disclaimer, the term of this patent is extended or adjusted under 35 U.S.C. 154(b) by 313 days.

(21) Appl. No.: 12/368,187

(22) Filed: Feb. 9, 2009

(65) Prior Publication Data

US 2009/0205827 A1 Aug. 20, 2009

Related U.S. Application Data

(63) Continuation-in-part of application No. 11/703,915, filed on Feb. 8, 2007, now Pat. No. 7,690,422.

(30) Foreign Application Priority Data

| | | |
|---|---|---|
| Feb. 8, 2006 | (GB) | 0602565.4 |
| Feb. 8, 2008 | (GB) | 0802406.9 |
| Feb. 8, 2008 | (GB) | 0802407.7 |
| Mar. 20, 2008 | (GB) | 0805299.5 |

(51) Int. Cl.
*E21B 19/00* (2006.01)

(52) U.S. Cl. ..... 166/90.1; 166/138; 166/202; 166/196

(58) Field of Classification Search ..... 166/90.1, 166/138, 202, 196
See application file for complete search history.

(56) References Cited

U.S. PATENT DOCUMENTS

| | | | | |
|---|---|---|---|---|
| 2,748,871 | A | 6/1956 | Brown | |
| 3,120,272 | A | 2/1964 | Cochran | |
| 3,374,841 | A * | 3/1968 | Current | 166/138 |
| 3,874,634 | A | 4/1975 | Gazda | |
| 4,364,407 | A | 12/1982 | Hilliard | |
| 4,377,179 | A | 3/1983 | Giebeler | |
| 4,495,073 | A | 1/1985 | Beimgraben | |
| 4,625,755 | A | 12/1986 | Reddoch | |
| 4,658,905 | A | 4/1987 | Burge | |
| 4,997,042 | A | 3/1991 | Jordan et al. | |
| 5,133,419 | A | 7/1992 | Barrington | |

(Continued)

FOREIGN PATENT DOCUMENTS

EP 0692345 A1 1/1996

(Continued)

OTHER PUBLICATIONS

International Search Report for Patent Application No. PCT/GB2009/000349, dated Jun. 24, 2009 (15 pages).

(Continued)

*Primary Examiner* — Giovanna Wright
(74) *Attorney, Agent, or Firm* — Osha • Liang LLP

(57) ABSTRACT

A method to connect a lifting assembly to a bore of a downhole tubular includes providing a communication tool to a distal end of the lifting assembly, the communication tool comprising a body assembly, an engagement assembly, a valve assembly and a seal assembly, sealingly engaging a first portion of the seal assembly in the bore of the downhole tubular, selectively permitting fluid to flow between the lifting assembly and the downhole tubular with the valve assembly, and disengaging the first portion of the seal assembly from the bore of the downhole tubular.

28 Claims, 7 Drawing Sheets

U.S. PATENT DOCUMENTS

| | | | | |
|---|---|---|---|---|
| 5,191,939 | A | 3/1993 | Stokley | |
| 5,501,280 | A | 3/1996 | Brisco | |
| 5,584,343 | A | 12/1996 | Coone | |
| 5,682,952 | A | 11/1997 | Stokley | |
| 5,735,348 | A | 4/1998 | Hawkins, III | |
| 5,890,538 | A | 4/1999 | Beirute et al. | |
| 5,918,673 | A | 7/1999 | Hawkins et al. | |
| 5,971,079 | A | 10/1999 | Mullins | |
| 6,173,777 | B1 | 1/2001 | Mullins | |
| 6,279,654 | B1 | 8/2001 | Mosing et al. | |
| 6,390,190 | B2 * | 5/2002 | Mullins | 166/90.1 |
| 6,415,862 | B1 | 7/2002 | Mullins | |
| 6,460,620 | B1 | 10/2002 | LaFleur | |
| 6,571,875 | B2 | 6/2003 | Bissonnette et al. | |
| 6,571,876 | B2 | 6/2003 | Szarka | |
| 6,578,632 | B2 | 6/2003 | Mullins | |
| 6,604,578 | B2 | 8/2003 | Mullins | |
| 6,666,270 | B2 | 12/2003 | Vann | |
| 6,675,889 | B1 | 1/2004 | Mullins et al. | |
| 6,715,542 | B2 | 4/2004 | Mullins | |
| 6,722,425 | B2 | 4/2004 | Mullins | |
| 6,732,804 | B2 | 5/2004 | Hosie et al. | |
| 6,779,599 | B2 | 8/2004 | Mullins et al. | |
| 6,883,605 | B2 | 4/2005 | Arceneaux et al. | |
| 7,028,769 | B2 | 4/2006 | Mullins | |
| 7,096,948 | B2 | 8/2006 | Mosing et al. | |
| 7,690,422 | B2 | 4/2010 | Swietlik et al. | |
| 2002/0129934 | A1 | 9/2002 | Mullins et al. | |
| 2005/0000695 | A1 | 1/2005 | LaFleur | |
| 2005/0173154 | A1 | 8/2005 | Lesko | |

FOREIGN PATENT DOCUMENTS

| | | | |
|---|---|---|---|
| EP | 1019614 | A1 | 7/2000 |
| EP | 1260671 | | 11/2002 |
| EP | 1632640 | | 3/2006 |
| GB | 2074634 | A | 11/1981 |
| GB | 2156402 | A | 10/1985 |
| GB | 2394973 | | 5/2004 |
| GB | 2435059 | A | 8/2007 |
| GB | 2439427 | A | 12/2007 |
| WO | 0061909 | | 10/2000 |
| WO | 2005090740 | | 9/2005 |
| WO | 2007127737 | | 11/2007 |

OTHER PUBLICATIONS

International Search Report for Patent Application No. PCT/GB2009/000339, dated Jul. 8, 2009 (13 pages).
International Search Report for Patent Application No. PCT/GB2009/000338, dated Jul. 9, 2009 (6 pages).
International Search Report for Patent Application No. PCT/GB2009/000344, dated Jul. 9, 2009 (6 pages).
Mechanical English translation of European Patent Application No. EP1632640, published Mar. 8, 2006 (6 pages).
International Search Report for Patent Application No. PCT/GB2010/000229, dated Apr. 6, 2010 (14 pages).
International Search Report for Patent Application No. PCT/GB2010/000230, dated Apr. 6, 2010 (14 pages).
Office Action in U.S. Appl. No. 12/368,199, dated Dec. 21, 2010 (24 pages).
Unknown, "Circulating/flowback tool cuts surge pressures," Drilling Contractor, Mar./Apr. 2001, pp. 30-31 (2 pages).
Video from the website www.drawworkslp.com <http://www.drawworkslp.com/page/78/video-resources>.
International Search Report for Patent Application No. PCT/GB2009/000344, dated Oct. 6, 2009 (18 pages).
International Search Report for Patent Application No. PCT/GB2009/000338, dated Oct. 13, 2009 (19 pages).
Canadian Association of Oilwell Drilling Contractors (CAODC), "SI Drilling Manual 1st Edition", Gulf Publishing Company, Section B20, p. 1.
Office Action in U.S. Appl. No. 12/368,217; dated Nov. 24, 2010 (18 pages).
Office Action in U.S. Appl. No. 12/368,161, dated Oct. 21, 2010 (26 pages).
Notice of Allowance in U.S. Appl. No. 12/368,199; dated Apr. 29, 2011 (9 pages).
Notice of Allowance in U.S. Appl. No. 12/368,217; dated May 11, 2011 (13 pages).

* cited by examiner

HYDRAULIC CONNECTOR APPARATUSES AND METHODS OF USE WITH DOWNHOLE TUBULARS

CROSS-REFERENCE TO RELATED APPLICATIONS

The present application claims benefit under 35 U.S.C. §120, as a Continuation-In-Part, to U.S. patent application Ser. No. 11/703,915, filed Feb. 8, 2007 now U.S. Pat. No. 7,690,422, which, in-turn, claims priority to United Kingdom Patent Application No. 0602565.4 filed Feb. 8, 2006. Additionally, the present application claims priority to United Kingdom Patent Application No. 0802406.9 and United Kingdom Patent Application No. 0802407.7, both filed on Feb. 8, 2008. Furthermore, the present application claims priority to United Kingdom Patent Application No. 0805299.5 filed Mar. 20, 2008. All priority applications and the co-pending U.S. parent application are hereby expressly incorporated by reference in their entirety.

BACKGROUND OF THE DISCLOSURE

1. Field of the Disclosure

The present disclosure generally relates to a connector establishing a fluid-tight connection to a downhole tubular. More particularly, the present disclosure relates to a connector establishing a fluid-tight connection between a downhole tubular and a lifting assembly. Alternatively, the present disclosure relates to a connector establishing a fluid-tight connection between a downhole tubular and another tubular.

2. Description of the Related Art

It is known in the industry to use a top-drive assembly to apply rotational torque to a series of inter-connected tubulars (commonly referred to as a drillstring comprised of drill pipe) to drill subterranean and subsea oil and gas wells. In other operations, a top-drive assembly may be used to install casing strings to already drilled wellbores. The top-drive assembly may include a motor, either hydraulic, electric, or other, to provide the torque to rotate the drillstring, which in turn rotates a drill bit at the bottom of the well.

Typically, the drillstring comprises a series of threadably-connected tubulars (drill pipes) of varying length, typically about 30 ft (9.14 m) in length. Typically, each section, or "joint" of drill pipe includes a male-type "pin" threaded connection at a first end and a corresponding female-type "box" threaded connection at the second end. As such, when making-up a connection between two joints of drill pipe, a pin connection of the upper piece of drill pipe (i.e., the new joint of drill pipe) is aligned with, threaded, and torqued within a box connection of a lower piece of drill pipe (i.e., the former joint of drill pipe). In a top-drive system, the top-drive motor may also be attached to the top joint of the drillstring via a threaded connection.

During drilling operations, a substance commonly referred to as drilling mud is pumped through the connection between the top-drive and the drillstring. The drilling mud travels through a bore of the drillstring and exits through nozzles or ports of the drill bit or other drilling tools downhole. The drilling mud performs various functions, including, but not limited to, lubricating and cooling the cutting surfaces of the drill bit. Additionally, as the drilling mud returns to the surface through the annular space formed between the outer diameter of the drillstring and the inner diameter of the borehole, the mud carries cuttings away from the bottom of the hole to the surface. Once at the surface, the drill cuttings are filtered out from the drilling mud and the drilling mud may be reused and the cuttings examined to determine geological properties of the borehole.

Additionally, the drilling mud is useful in maintaining a desired amount of head pressure upon the downhole formation. As the specific gravity of the drilling mud may be varied, an appropriate "weight" may be used to maintain balance in the subterranean formation. If the mud weight is too low, formation pressure may push back on the column of mud and result in a blow out at the surface. However, if the mud weight is too high, the excess pressure downhole may fracture the formation and cause the mud to invade the formation, resulting in damage to the formation and loss of drilling mud.

As such, there are times (e.g., to replace a drill bit) where it is necessary to remove (i.e., "trip out") the drillstring from the well and it becomes necessary to pump additional drilling mud (or increase the supply pressure) through the drillstring to displace and support the volume of the drillstring retreating from the wellbore to maintain the well's hydraulic balance. By pumping additional fluids as the drillstring is tripped out of the hole, a localized region of low pressure near or below the retreating drill bit and drill pipe (i.e., suction) may be reduced and any force required to remove the drillstring may be minimized. In a conventional arrangement, the excess supply drilling mud may be pumped through the same connection, between the top-drive and drillstring, as used when drilling.

As the drillstring is removed from the well, successive sections of the retrieved drillstring are disconnected from the remaining drillstring (and the top-drive assembly) and stored for use when the drillstring is tripped back into the wellbore. Following the removal of each joint (or series of joints) from the drillstring, a new connection must be established between the top-drive and the remaining drillstring. However, breaking and re-making these threaded connections, two for every section of drillstring removed, is very time consuming and may slow down the process of tripping out the drillstring.

Previous attempts have been made at speeding up the process of tripping-out. GB2156402A discloses methods for controlling the rate of withdrawal and the drilling mud pressure to maximize the speed of tripping-out the drillstring. However, the amount of time spent connecting and disconnecting each section of the drillstring to and from the top-drive is not addressed.

Another mechanism by which the tripping out process may be sped up is to remove several joints at a time (e.g., remove several joints together as a "stand"), as discussed in GB2156402A. By removing several joints at once in a stand (and not breaking connections between the individual joints in each stand), the total number of threaded connections that are required to be broken may be reduced by 50-67%. However, the number of joints in each stand is limited by the height of the derrick and the pipe rack of the drilling rig, and the method using stands still does not address the time spent breaking the threaded connections that must still be broken.

In addition to the above, there may be applications where it is desirable to displace fluid from the borehole, particularly, for example, when lowering the drillstring (or a casing-string) in deepwater drilling applications. In such deepwater applications, the seabed accommodates equipment to support the construction of the well and the casing used to line the wellbore may be hung and placed from the seabed. In such a configuration, a drillstring (from the surface vessel) may be used as the mechanism to convey and land the casing string into position. As the drillstring is lowered, successive sections of drillstring would need to be added to lower the drillstring (and attached casing string) further. However, as the bore of the typical drillstring is much smaller than the bore of a typical string of casing, fluid displaced by the casing string will flow up and exit through the smaller-bore drillstring, at increased pressure and flow rates. Designs such as those disclosed in GB2435059A would not allow reverse flow of drilling mud (or seawater) as would be required in such a casing installation operation.

Embodiments of the present disclosure seek to address these and other issues of the prior art.

SUMMARY OF THE CLAIMED SUBJECT MATTER

In one aspect, embodiments of the present disclosure relate to a method to connect a lifting assembly to a bore of a downhole tubular including providing a communication tool to a distal end of the lifting assembly, the communication tool comprising a body assembly, an engagement assembly, a valve assembly and a seal assembly, sealingly engaging a first portion of the seal assembly in the bore of the downhole tubular, selectively permitting fluid to flow between the lifting assembly and the downhole tubular with the valve assembly, and disengaging the first portion of the seal assembly from the bore of the downhole tubular.

In another aspect, embodiments of the present disclosure relate to a communication tool to interchangeably connect a lifting assembly to downhole tubulars, the communication tool including a tool body, an engagement assembly adapted to selectively permit engagement of the communication tool with the downhole tubulars, a valve assembly adapted to selectively permit flow between the lifting assembly and the downhole tubulars, and a seal assembly including a first portion adapted to engage a bore of a first downhole tubular and a second portion adapted to engage a bore of a second downhole tubular.

In another aspect, embodiments of the present disclosure relate to a portion of a seal assembly portion to connect a fluid supply to a downhole tubular including a connector body comprising a surface inclined with respect to an axis of the downhole tubular, a seal member slidably disposed about the connector body, and a locking element slidably disposed about the connector and comprising a second inclined surface to cooperate with the inclined surface of the connector body.

BRIEF DESCRIPTION OF DRAWINGS

Features of the present disclosure will become more apparent from the following description in conjunction with the accompanying drawings.

DETAILED DESCRIPTION

Select embodiments describe a tool to direct fluids between a top-drive (or other lifting) assembly and a bore of a downhole tubular. In particular, the tool may include an engagement assembly to extend one or more seal assemblies into the bore of one or more downhole tubulars and a valve assembly to selectively allow pressurized fluids from the top-drive assembly to enter the one or more downhole tubular and vice versa.

Figure 1A:
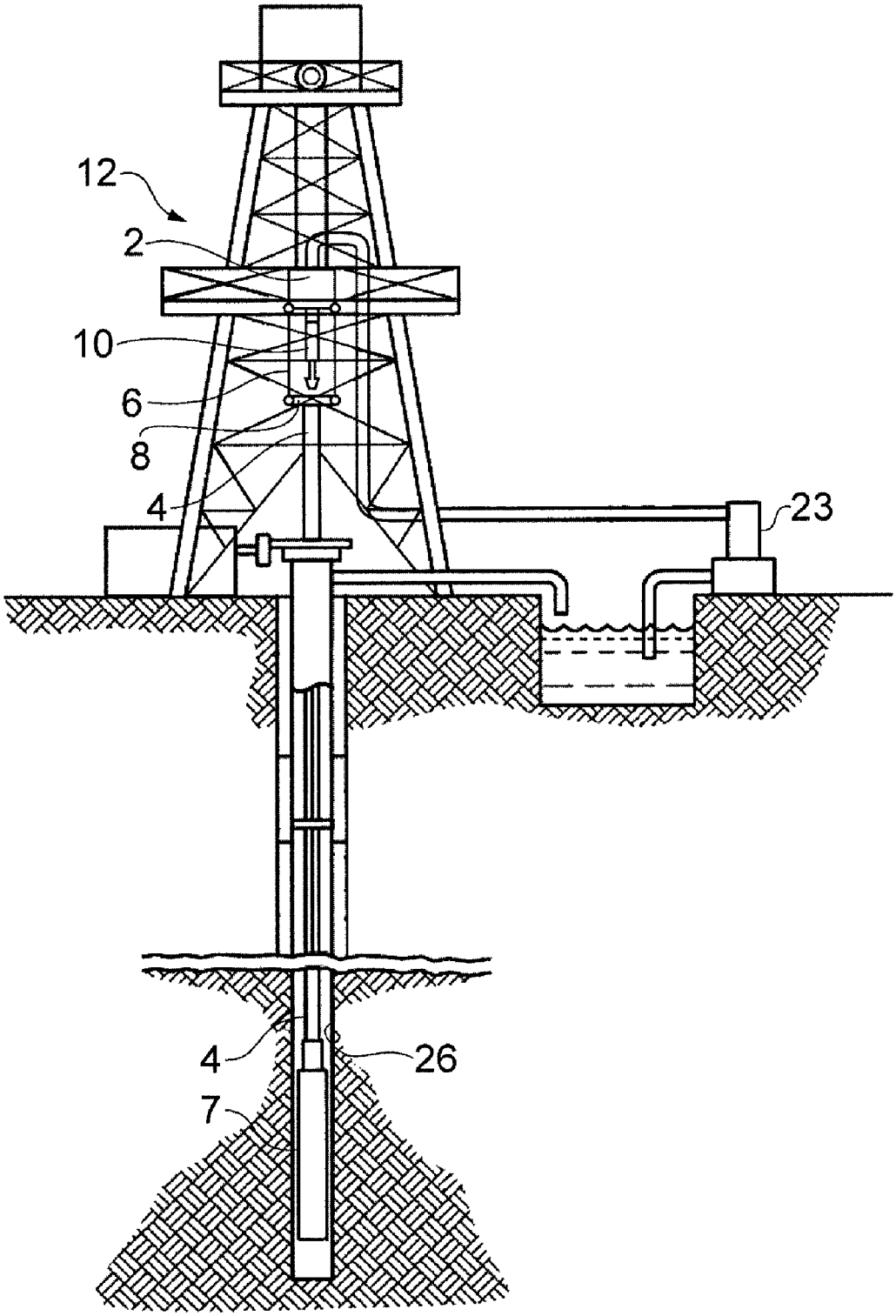
FIGS. 1*a* and 1*b* schematically depict a connector in accordance with embodiments of the present disclosure and depicts the connector in position between a top-drive and a downhole tubular.
Figure 1B:
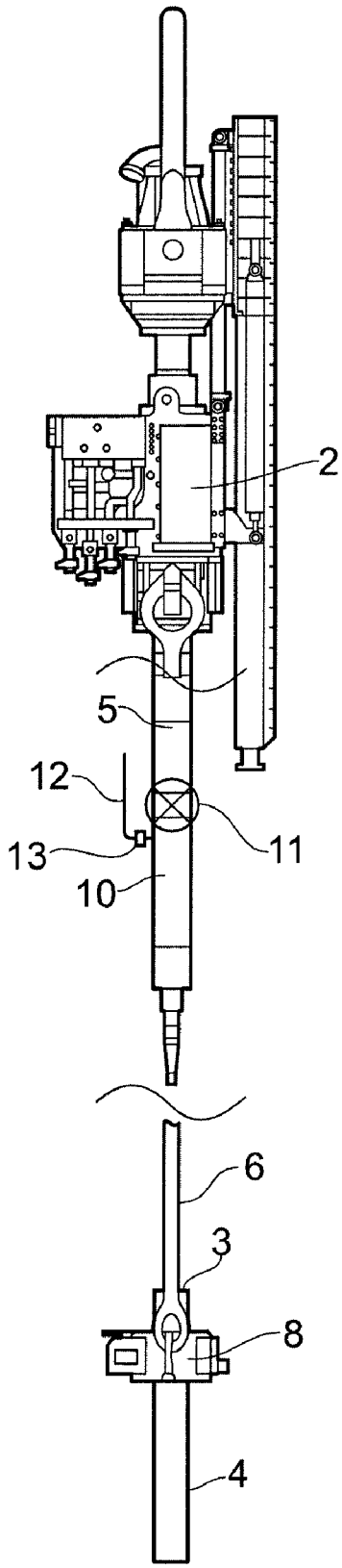

Referring initially to FIGS. 1*a* and 1*b* (collectively referred to as "FIG. 1"), a top-drive assembly 2 is shown connected to a proximal end of a string of downhole tubulars 4. As shown, top-drive 2 may be capable of raising ("tripping out") or lowering ("tripping in") downhole tubulars 4 through a pair of lifting bales 6, each connected between lifting ears of top-drive 2, and lifting ears of a set of elevators 8. When closed (as shown), elevators 8 grip downhole tubulars 4 and prevent the string from sliding further into a wellbore 26 (below).

Thus, the movement of string of downhole tubulars 4 relative to the wellbore 26 may be restricted to the upward or downward movement of top-drive 2. White top-drive 2 (as shown) must supply any upward force to lift downhole tubular 4, downward force is sufficiently supplied by the accumulated weight of the entire free-hanging string of downhole tubulars 4, offset by their accumulated buoyancy forces of the downhole tubulars 4 in the fluids contained within the wellbore 26. Thus, as shown, the top-drive assembly 2, lifting bales 6, and elevators 8 must be capable of lifting (and holding) the entire free weight of the string of downhole tubulars 4.

As shown, string of downhole tubulars 4 may be constructed as a string of threadably connected drill pipes (e.g., a drillstring 4), may be a string of threadably connected casing segments (e.g., a casing string 7), or any other length of generally tubular (or cylindrical) members to be suspended from a rig derrick 12. In a conventional drillstring or casing string, the uppermost section (i.e., the "top" joint) of the string of downhole tubulars 4 may include a female-threaded "box" connection 3. In some applications, the uppermost box connection 3 is configured to engage a corresponding male-threaded ("pin") connector 5 at a distal end of the top-drive assembly 2 so that drilling-mud or any other fluid (e.g., cement, fracturing fluid, water, etc.) may be pumped through top-drive 2 to bore of downhole tubulars 4. As the downhole tubular 4 is lowered into a well, the uppermost section of downhole tubular 4 must be disconnected from top-drive 2 before a next joint of string of downhole tubulars 4 may be threadably added.

As would be understood by those having ordinary skill, the process by which threaded connections between top-drive 2 and downhole tubular 4 are broken and/or made-up may be time consuming, especially in the context of lowering an entire string (i.e., several hundred joints) of downhole tubulars 4, section-by-section, to a location below the seabed in a deepwater drilling operation. The present disclosure therefore relates to alternative apparatus and methods to establish the connection between the top-drive assembly 2 and the string of downhole tubulars 4 being engaged or withdrawn to and from the wellbore. Embodiments disclosed herein enable the fluid connection between the top-drive 2 (in communication with a mud pump 23 and the string of downhole tubulars 4 to be made using a hydraulic connector tool 10 located between top-drive assembly 2 and the top joint of string of downhole tubulars 4.

However, it should be understood that while a top-drive assembly 2 is shown in conjunction with hydraulic connector 10, in certain embodiments, other types of "lifting assemblies" may be used with hydraulic connector 10 instead. For example, when "running" casing or drill pipe (i.e., downhole tubulars 4) on drilling rigs (e.g., 12) not equipped with a top-drive assembly 2, hydraulic connector 10, elevator 8, and lifting bales 6 may be connected directly to a hook or other lifting mechanism to raise and/or lower the string of downhole tubulars 4 while hydraulically connected to a pressurized fluid source (e.g., a mud pump, a rotating swivel, an IBOP, a TIW valve, an upper length of tubular, etc.). Further still, while some drilling rigs may be equipped with a top-drive assembly 2, the lifting capacity of the lifting ears (or other components) of the top-drive 2 may be insufficient to lift the entire length of string of downhole tubular 4. In particular, for extremely long or heavy-walled tubulars 4, the hook and lifting block of the drilling rig may offer significantly more lifting capacity than the top-drive assembly 4.

Therefore, throughout the present disclosure, where connections between hydraulic connector 10 and top-drive assembly 2 are described, various alternative connections between the hydraulic connector and other, non-top-drive lifting (and fluid communication) components are contemplated as well. Similarly, throughout the present disclosure, where fluid connections between hydraulic connector 10 and top-drive assembly 2 are described, various fluid and/or lifting arrangements are contemplated as well. In particular, while fluids may not physically flow through a particular lifting assembly lifting hydraulic connector 10 and into tubular, fluids may flow through a conduit (e.g., hose, flex-line, pipe, etc) used alongside and in conjunction with the lifting assembly and into hydraulic connector 10.

Figure 2A:
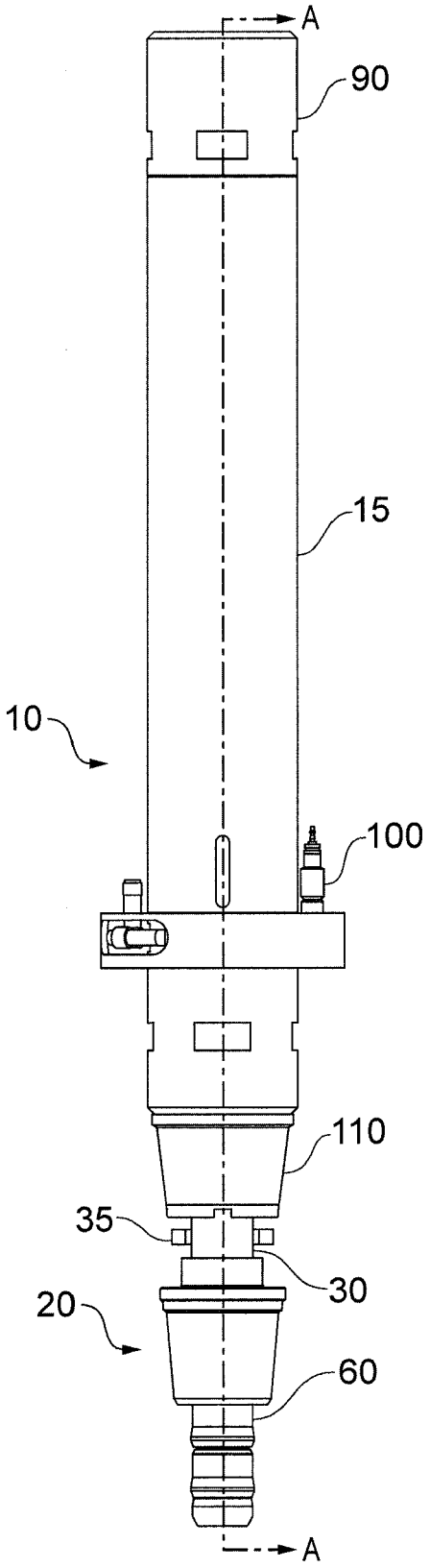
FIG. 2*a* is a side view of a connector in accordance with embodiments disclosed herein.
Figure 2B:
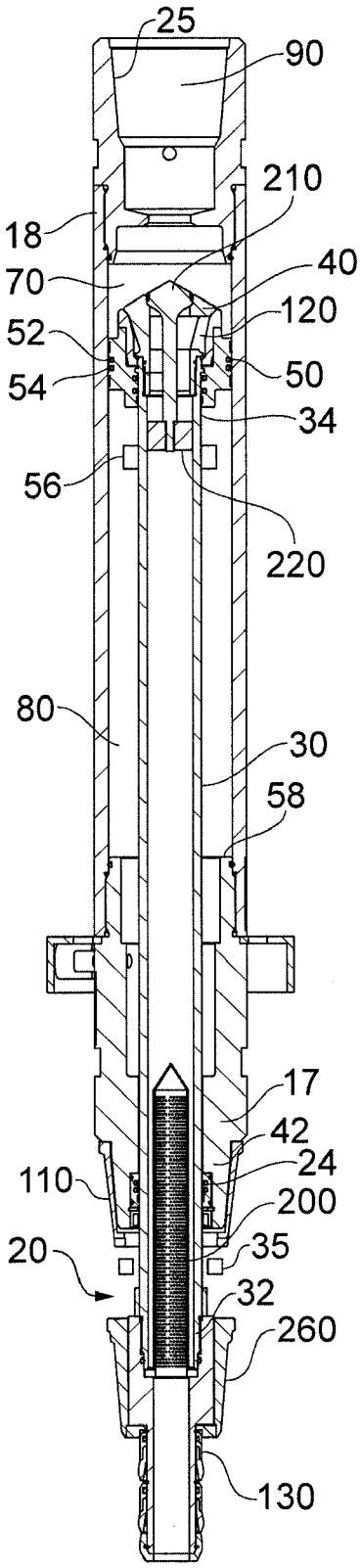
FIG. 2*b* is a sectional side view of the connector at section A-A of FIG. 2*a* with a retracted piston-rod assembly.
Figure 2C:
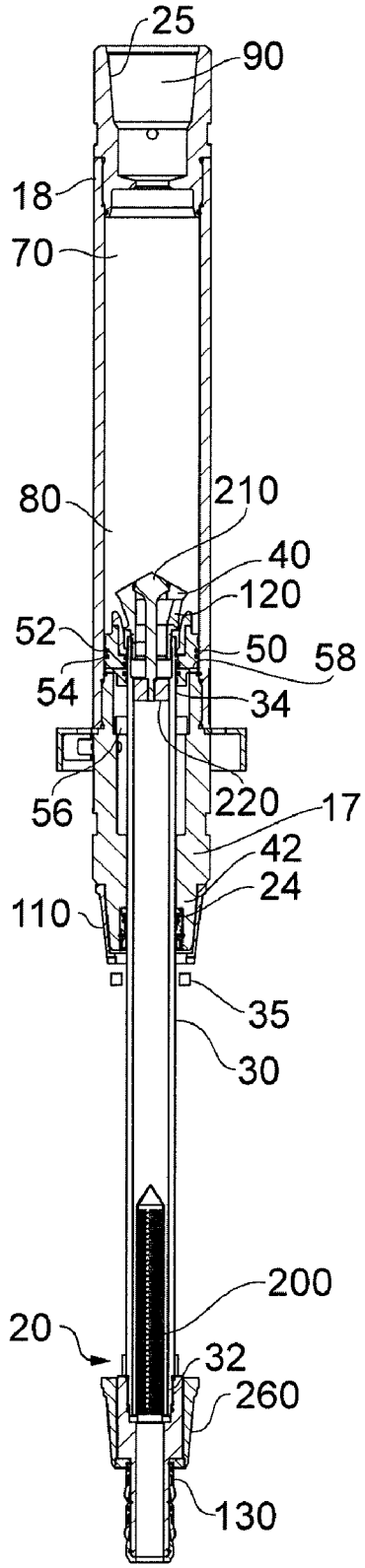
FIG. 2*c* is a sectional side projection of the connector showing the piston-rod assembly in an extended position.

Referring now to FIGS. 2*a*, 2*b* and 2*c* (collectively referred to as "FIG. 2"), a hydraulic connector 10 in accordance with certain embodiments of the present disclosure is shown. Hydraulic connector 10 includes an engagement assembly including a main or primary cylinder 15 and a piston-rod assembly 20 slidably engaged and configured to reciprocate within cylinder 15. As shown, piston-rod assembly 20 includes a hollow tubular rod 30 configured to be slidably engagable within cylinder 15 so that a first (lower) end 32 of tubular rod 30 may protrude outside a distal end of cylinder 15 and a second (upper) end 34 may be contained within cylinder 15. Tubular rod 30 and cylinder 15 may be arranged such that their longitudinal axes are coincident and tubular rod 30 is slidably disposed within cylinder 15 such that piston-rod assembly 20 may telescopically extend through the cylinder 15 between at least one a retracted position (e.g., FIG. 2*b*) and at least one extended position (e.g., FIG. 2*c*).

Referring still to FIG. 2, a removable bung 60 comprising seals 130, 260 is shown located on first end 32 of tubular rod 30. While seals 130 and 260 are shown to be a particular configuration of seals (e.g., cup seal 260), it should be understood that seals 130, 260 may be of any type known by those having ordinary skill to effectively seal with a variety of types of downhole tubulars 4. Furthermore, in certain embodiments, bung 60 (and seals 130, 260) may be made from a resilient and/or elastomeric material (e.g., rubber, nylon, polyethylene, silicone, etc.) and may be shaped to fit into a proximal end (e.g., box 3 of FIG. 1) of string of downhole tubulars 4. Similarly, bung 60 may be configured to seal atop or around proximal end of downhole tubulars 4.

Additionally, because bung 60 is removable (e.g., threaded at a distal end of tubular rod 30), various configurations for downhole tubular may be accommodated with a single hydraulic connector 10. For example, as shown in FIG. 2, bung 60 may include two sets of seals, a larger, cup-style seal 260 and a pair of smaller seals 130. In such a configuration, bung 60 may be configured to seal with a downhole tubular 4 having a complex inner bore profile, i.e., a profile having a large initial diameter and a reduced-diameter subsequent diameter. However, bung 60 may also be capable of sealingly engaging two different types of strings of downhole tubulars 4 without requiring replacement of bung 60. For example, small-diameter seals 130 may be configured to seal inside a drillstring, while larger-diameter seal 230 is configured to seal against a casing string. Thus, operations using hydraulic connector 10 including running a first string (i.e., casing) may be immediately followed with an operation with a second string (i.e., drill pipe) and vice versa. As such, various configurations for bung 60 may be used with hydraulic connector 10 of the present disclosure. Furthermore, having a replaceable bung 60 allows bungs designed for dedicated service with one type of downhole tubular (e.g., casing) to be swapped for bungs designed for dedicated service with another type of downhole tubular (e.g., drill pipe) with little rig-up time required.

In select embodiments, bung 60 and seals 130, 260 may be configured to engage the top end of a string of downhole tubulars 4 when piston-rod assembly 20 is in its extended position, thereby providing a fluid tight seal between hydraulic connector 10 (and top-drive assembly 2) and the string of downhole tubulars 4. Thus, in select embodiments, hydraulic connector 10 may include a seal assembly including tubular rod 30, bung 60, and seals 130, 260 such that seals 130, 260 effectuate a seal between an inner bore of downhole tubular 4 and an outer profile of tubular rod 30. Therefore, in select embodiments, bung 60 and/or seals 130, 260 may seal on, in, or around box 3 in the top joint of string of downhole tubulars 4.

Referring still to FIG. 2, a tubular filter 200 may be disposed between the first end of the tubular rod 30 and the bung 60. The filter 200 may be substantially cylindrical with a closed end and an open end between its side-walls. The open end of the filter 200 may comprise an outer-flanged portion about its circumference, which may abut the first end of the tubular rod 30. As shown, the bung 60 threadably engages an outer portion of the first end of the tubular rod 30 and an abutment shoulder within bung 60 abuts the flanged portion of the filter 200 to secure it between the tubular rod 30 and bung 60. In this manner the bung 60 and filter 200 may easily be disconnected from the lower end of tubular rod 30 for replacement, inspection, and/or cleaning.

As shown, filter 200 is arranged with its open end facing (downward) toward bung 60 and the closed end (upward) facing cap 40. Thus, filter 200 may be contained primarily within tubular rod 30 so that flow from the string of downhole tubulars 4 to the hydraulic connector 10 flows will first enter the open end of filter 200, then encounter the side-walls, and finally the closed end of the filter 200. The filter 200 may be sized so that a sufficient gap is provided between the side-walls of the filter and the tubular rod 30, whilst maintaining a sufficient internal diameter of the filter. The dimensions of the filter 200 (e.g., diameter, length, etc.) relative to the tubular rod 30 may be selected so as to reduce the pressure drop across the filter. In certain embodiments, filter 200 may comprise a perforated pipe having a perforated closed end. In alternative embodiments filter 200 may comprise a wire mesh. In still further alternative embodiments, filter 200 may comprise a non-perforated closed end, or any other conventional filter arrangement known to those having ordinary skill.

At a first (lower) end 17, cylinder 15 may include an end plug 42 through which the tubular rod 30 may be able to reciprocate. The end plug 42 may be integral with the cylinder 15 (as shown in FIG. 2*b*) or may be configured to be threaded into distal end 17 of cylinder 15, although those having ordinary skill will appreciate that other connection mechanisms may be used. An additional threaded (or otherwise connected) member 110 may be provided on a distal end of end plug 42. Threaded member 110 may be integral with the end plug 42 or may be connected to end plug 42 by virtue of a threaded connection. As shown, threaded member 110 includes a passage and a bore to allow tubular rod 30 to pass therethrough as hydraulic connector 10 reciprocates between extended retracted positions. In select embodiments, threaded member 110 may be configured to seal the inside of cylinder 15 from outside and to allow tubular rod 30 to slide in or out of the cylinder 15. As would be understood by those having ordinary skill, seals, (e.g., o-rings) 24 may be used to seal between end plug 42 and tubular rod 30.

The threaded member 110 may further include an outwardly-facing threaded section 170. In one mode of operation with the bung 60 removed from the tubular rod 30, the threaded section may be threadably connected to an open end (i.e., a "box" end) of downhole tubulars 4. The hydraulic connector 10 may therefore be used to transmit torque from the top-drive 2 to the downhole tubulars 4. Accordingly, in order to transmit drive, the threaded connections between the top-drive 2, threaded member 110 and downhole tubulars 4 may be orientated in the same direction. The threaded section 170 of the threaded member 110 may also be adapted to connect to other tools, such as a cementing tool.

Additionally, threaded member 110 may be removable from first end cap 42 and may therefore be interchangeable with alternative threaded members. This interchangeability may facilitate repair of the threaded member 110 and may also enable differently-shaped threaded members (110) to be configured for use with a particular downhole tubular 4.

Referring still to FIG. 2, the connector 10 may be provided with a clamp 35, which may be disposed about a portion of the tubular rod 30 below cylinder 15. The clamp may be secured to the cylinder 15 or any other fixed body (relative to the top-drive assembly 2) so that the clamp 35 locks the tubular rod 30 in a desired (retracted, extended or intermediate) position. Alternatively, the clamp 35 may not be secured and may simply limit the retraction of the tubular rod 30 into the cylinder 15.

At the opposite (upper) end 18 of cylinder 15, a socket 90 with a threaded connection 25 may be provided for engagement with top-drive assembly 2. As shown, threaded connection 25 may include a standard threaded female box connection which may be configured to threadably engage a corresponding pin thread of top-drive assembly 2. Therefore, as shown, top-drive assembly 2 may provide drilling fluid to cylinder 15 through threaded connection 25.

In one arrangement there may be a valve 11 (see FIG. 1) between the top-drive assembly 2 and the connector 10. The valve 11 may be integral to the connector 10 or top-drive assembly 2 or may be a separate component altogether. For example, the valve 11 may be an Internal Blow Out Preventer (IBOP) valve of top-drive assembly 2 or a separate TIW ball valve (or any other type of valve) located between the connector 10 and the top-drive assembly 2. A side-port 12 may also be provided between the valve 11 and connector 10. The side port 12 may comprise a valve 13 to selectively open or close side port 12. As would be understood by those having ordinary skill, valves 11, 13 may be operated manually or remotely.

Referring again to FIG. 2, the piston-rod assembly 20 may include a cap 40 mounted on second (upper) end 34 of tubular rod 30. As shown, hydraulic connector 10 further includes a piston 50 slidably mounted on tubular rod 30 inside cylinder 15. As shown, piston 50 is free to reciprocate between the cap 40 and the end-cap 42. Additionally, in certain embodiments, piston 50 may also be capable of rotating about its center axis with respect to cylinder 15. Furthermore, the entire assembly (20, 40, 50 and 60) may be able to slide (and/or rotate) with respect to cylinder 15. As such, the inside of the cylinder 15 may be divided by the piston 50 into a first (lower) chamber 80 and a second (upper) chamber 70. When viewed in a downward direction from above (e.g., from the top-drive), the projected area of the piston 50 may be less than the projected area of the cap 40 such that when the piston 50 abuts the cap 40, the pressure force from the fluid in the second chamber 70 acting on the cap 40 is greater than that acting on the piston 50.

The piston 50 is free to move between the cap 40 and a first abutment shoulder 56 may be provided on the tubular rod 30. The first abutment shoulder 56 may be in the form of a ring about the tubular rod 30. Furthermore, the cylinder 15 may comprise a second abutment shoulder 58 to limit the travel of the piston 50 towards the end plug 42. The second abutment shoulder 58 may be sized so that the first abutment shoulder 56 on the tubular rod 30 is unable to abut the second abutment shoulder 58 in the cylinder 15. In other words the first abutment shoulder 56 on the tubular rod 30 may fit within the second abutment shoulder 58 provided in the cylinder 15 so that they may pass one another and the travel of the tubular rod 30 in the cylinder 15 is not limited by an interaction between the first and second abutment shoulders 56, 58. In contrast, the travel of the tubular rod 30 may be limited by the piston 50 abutting both the second abutment shoulder 58 and the cap 40.

In certain embodiments, the first and second chambers 80 and 70 may be energized with air and drilling mud respectively. Alternatively, any appropriate actuation fluid, including, but not limited to, air, nitrogen, water, drilling mud, and hydraulic fluid, may be used to energize lower chamber 80. Alternatively still, air (or any other gas) may be pressurized or evacuated to lower chamber 80 to facilitate movement of piston 50. The piston 50 may be sealed against the tubular rod 30 and cylinder 15, for example, by means of o-ring seals 52 and 54, to prevent fluid communication between the two chambers 70 and 80. First chamber 80 may be in fluid communication with an air supply via a port 100, which may selectively pressurize first chamber 80. Second chamber 70 may be provided with drilling mud from the top-drive 2 via a socket 90, which may (as shown) be a box component of a rotary box-pin threaded connection.

In the disposition of components shown in FIG. 2*b*, the piston 50 and cap 40 are touching, so that drilling mud cannot flow from the second chamber 70 to the string of downhole tubulars 4. FIG. 2*c* shows an alternative position of the cap 40 with respect to piston 50. As shown in FIG. 2*c*, with the cap 40 and piston 50 apart, holes 120 are exposed in the side of the cap 40. These holes 120 provide a fluid communication path between the second chamber 70 and the interior of the tubular rod 30. Thus drilling mud may flow from the second chamber 70 to the string of downhole tubulars 4, via the holes 120 in the cap 40 and the tubular rod 30 when cap 40 is displaced above piston 50.

Figure 3A:
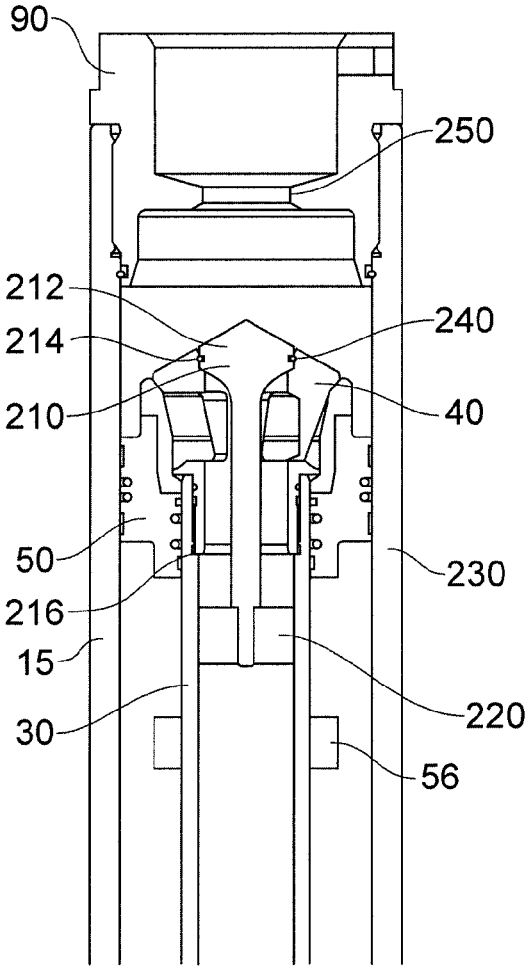
FIGS. 3*a* and 3*b* are a more detailed sectional view of the connector of FIGS. 2*a*, 2*b*, and 2*c* showing a poppet valve in a closed position (FIG. 3*a*) and an open position (FIG. 3*b*).
Figure 3B:
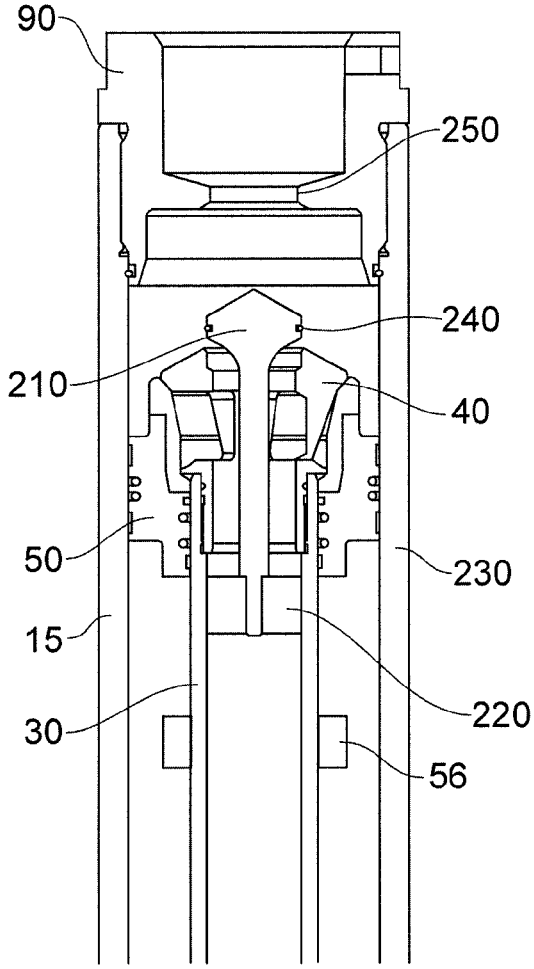

Referring now to FIGS. 3*a* and 3*b* (collectively referred to as "FIG. 3"), further detail of the structure of the cap 40 and piston 50 is shown. The hydraulic connector 10 may further include a one-way flow valve 210 located on the cap 40. In the embodiment shown in FIG. 3, the one-way flow valve 210 is a poppet valve, but it will be appreciated by those skilled in the art that the one-way flow valve 210 may be any type of one-way flow valve, for instance a flapper valve or a ball valve. FIG. 3*a* shows poppet valve 210 in a closed position and FIG. 3*b* shows poppet valve 210 in an open position.

As shown, poppet valve 210 comprises a seat portion 214 on the cap 40 and a corresponding poppet head 212. A seal 240 is provided on the poppet head 212 to ensure a fluid tight seal between the poppet head 212 and poppet seat 214 when poppet valve 210 is in the closed position. In select embodiments, the socket 90 may also comprise a shoulder 250 to abut the poppet head 212 when the piston-rod assembly 20 is in a fully retracted position.

The poppet valve 210 may further include a weighted member 220 which may be attached to the poppet head 212 via a poppet stem 230. The weighted portion 230 may comprise one or more ports (not shown) to allow the free passage of fluid through the tubular rod 30. The ports may be shaped so as to minimize the pressure drop across the weighted portion 230. The weighted portion 230 may also serve to guide the motion of the poppet valve 210 in the tubular rod 30. As such, weighted portion 230 may slide in the tubular rod 30 and the motion of the weighted portion 230 (and therefore poppet valve 210) may be limited (in the upward direction) by an abutment shoulder 216 in the tubular rod 30. Furthermore, the weighted portion 230, by virtue of gravity, biases the poppet valve 210 into a closed position. Alternatively, the poppet valve 210 may be spring biased.

Figure 4:
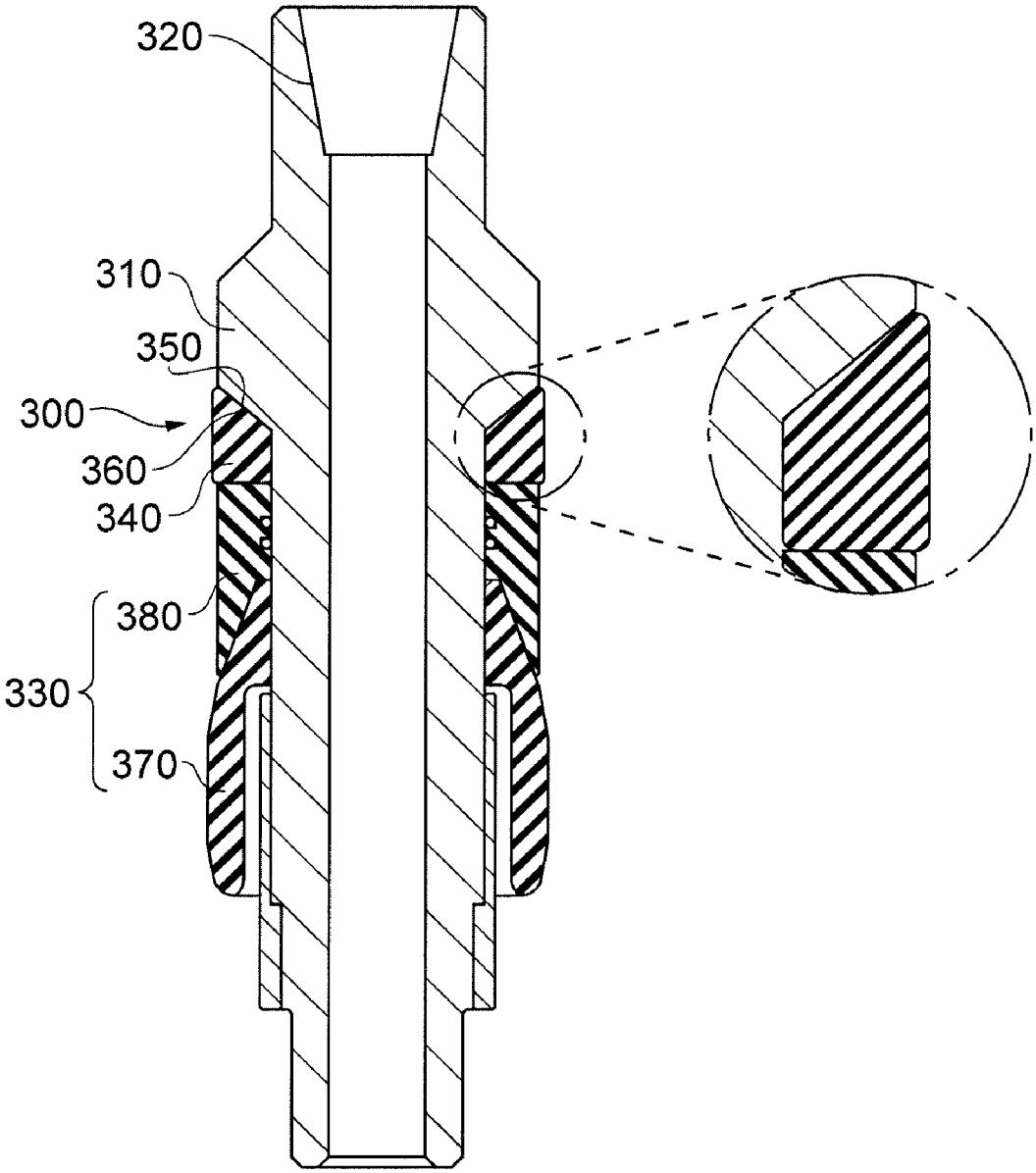
FIG. 4 is a side view of a seal assembly in accordance with embodiments of the present disclosure.

Referring now to FIG. 4, the hydraulic connector 10 may alternatively connect to a downhole tubular 4 with a packer seal 300. In particular, the packer seal 300 may be adapted to engage a downhole tubular having a larger inner diameter (e.g., a casing string), whereas the bung 60 described above may be adapted to engage a downhole tubular having a smaller inner diameter (e.g., a string of drill pipe). As shown, packer seal 300 may comprise a body 310, that may be in fluid communication with the hydraulic connector 10 (i.e., and top-drive assembly 2), and may provide a flow path to the downhole tubular 4. The body 310 may include a socket 320 which may be threadably connected to the threaded member 110 of the hydraulic connector 10 or may be connected (threadably or otherwise) to the first end 32 of the tubular rod 30 in place of the bung 60.

The packer seal 300 may include an expandable seal member 330 to provide a seal between the body 310 and the downhole tubular 4. Alternatively, seal member 330 may not be configured to expand. At least a part of the seal member 330 is slidably disposed about the body 310. The packer seal 300 further comprises a locking element 340 for selectively locking the seal assembly to the downhole tubular 4. The locking element 340 may also be slidably disposed about the body 310.

The body 310 may also include an inclined surface 350 which may be inclined with respect to a longitudinal axis of the body 310. The locking element 340 may also include a first inclined surface 360 which may be disposed adjacent to the inclined surface 350 of the body 310. The locking element 340 may therefore be located between the inclined surface 350 of the body 310 and the seal member 330. The first inclined surface 360 of the locking element 340 may have substantially the same angle as the inclined surface 350 of the body 310 and the first inclined surface 360 may be adapted to cooperate with the inclined surface of the body 310.

The seal member 330 may be independently slidably disposed about the body 310 and the locking element 340 may be slidably disposed about the body 310 between the inclined surface 350 of the body 310 and the seal member 330. Thus, upon connection of the packer seal 300 to the downhole tubular 4, the seal member 330 may slide towards the locking element 340 such that the locking element 340 is urged towards the inclined surface 350 of the body 310. The locking element 340 may therefore be forced in a radially outward direction by this interaction and the locking element 340 engages an inner surface of the downhole tubular 4.

The locking element 340 may be ring shaped with a cross section having a side (first inclined surface 360) inclined with respect to the longitudinal axis of the body 310 and two sides substantially parallel with respect to the longitudinal axis of the body 310. The locking element 340 may be deformable and/or resilient and may be made from an elastomeric material (e.g., rubber, nylon, polyethylene, silicone, etc.).

The seal member 330 may include a seal portion 370 and a sleeve 380. The sleeve 380 may be partially disposed around the seal portion 370 and the seal portion may be sized so as to interact with the inner surface of the downhole tubular 4 upon insertion into the downhole tubular 4. The seal portion 370 may be a packer cup and/or a packing seal. In an alternative arrangement, the seal portion 370 and sleeve 380 may be a single component. In a further alternative arrangement, the locking element 340 and seal member 330 may be a single component such that the locking element 340 comprises the seal member 330 or vice versa. In other words, the locking element 340 may additionally provide a seal with the downhole tubular or the seal member 330 may additionally provide a locking function with the downhole tubular.)

Upon connection of the packer seal 300 to the downhole tubular 4, the seal member 330 may engage an inner surface of the downhole tubular 4 (e.g., a box connection or the inner bore of the downhole tubular) and the seal member 330 may move in a first direction with respect to the body 310 such that the seal member 330 urges the locking element 340 towards the inner surface of the downhole tubular 4 by a sliding interaction between the inclined surface 350 of the body and the first inclined surface 360 of the locking element 340. The locking element 340 may be brought into locking engagement with the inner surface of the downhole tubular. Upon disconnection of the packer seal 300 from the downhole tubular 4, the seal member 330 may move in a second direction with respect to the body such that the locking element 340 may be released from the locking engagement with the inner surface of the downhole tubular 4.

The packer seal 300 may therefore advantageously translates a vertical force acting on the seal assembly into a radial locking force acting on the inner surface of the downhole tubular. This may be particularly important when connecting to casing sections, as such tubulars generally have a larger diameter than drill pipe and the inside of cylinder 15 described above. Due to this area difference, the pressure force from the downhole tubular 4 acting on the packer seal 300 may be greater than the pressure force from the in the hydraulic connector acting on the piston-rod assembly 20. There may therefore be a hydraulic imbalance with a tendency to expel the piston-rod assembly 20 and sealing assembly 300 from the downhole tubular 4. However, the sealing assembly may resist this hydraulic imbalance by the locking action of the locking element 340 against the inside of the downhole tubular 4. In addition, the seal member 330 may provide a fluid tight seal between the body 310 of the packer seal 300 and the downhole tubular 4.

Figure 5:
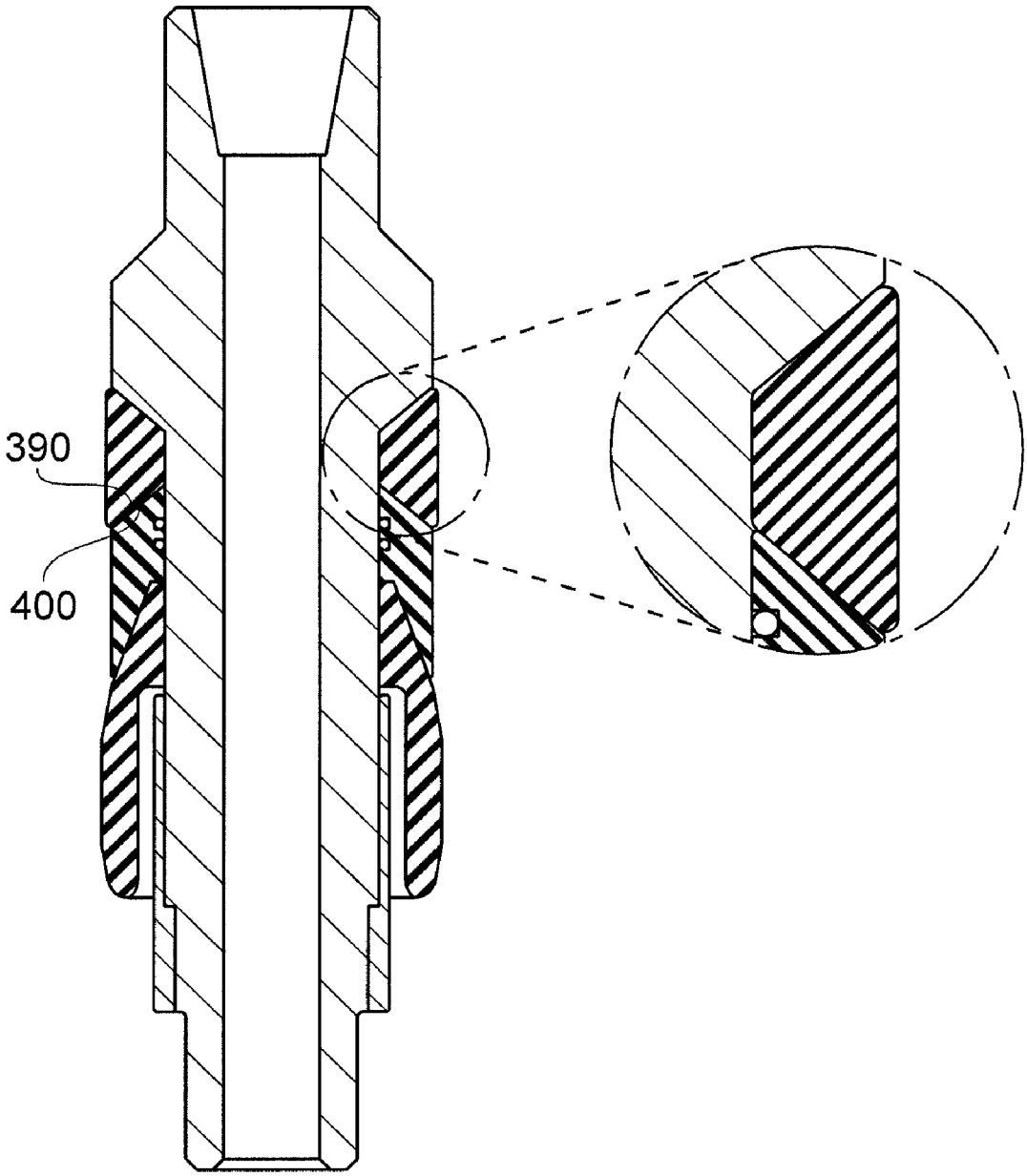
FIG. 5 is a side view of an alternative seal assembly in accordance with embodiments of the present disclosure.

Referring now to an alternative arrangement for a packer seal 300 shown in FIG. 5, the locking element 340 may comprise a second inclined surface 390 inclined with respect to the longitudinal axis of the downhole tubular 4. Similarly, the seal member 330 may also comprise an inclined surface 400 for cooperation with the second inclined surface 390 of the locking element 340. The second inclined surface 390 of the locking element 340 and the inclined surface 400 of the seal member 330 may be arranged so that the locking element is urged in a radially outward direction by the interaction between the second inclined surface 390 and the inclined surface 400 as the seal member 330 moves towards the inclined surface 350 of the body 310 (i.e. as the seal member moves in the first direction). The second inclined surface 390 and inclined surface 400 may provide the packer seal 300 with additional means for urging the locking element 340 into engagement with the downhole tubular 4, thereby increasing the locking force.

Furthermore, the second inclined surface 390 and inclined surface 400 may ease the removal of the seal assembly from the downhole tubular as the radial component of the friction between the locking element 340 and seal member 330 may be been reduced. This may assist the locking element 330 in returning to its original position, i.e. out of locking engagement with the downhole tubular 4.

In a further alternative arrangement (not shown), the packer seal 300 and bung 60 may be provided in tandem with the bung 60 connected to the body 310 of the packer seal 300 and the seal assembly connected to the first end 32 of the tubular rod 30. As casing sections may have a larger diameter than drill pipe sections, the bung 60 may fit inside the casing section when the packer seal 300 connects to the casing section. Furthermore, as the bung 60 may be connected to the packer seal 300 which may, in turn, be connected to the tubular rod 30, the seal assembly may not interfere with the engagement of the bung 60 with a drill pipe section. Advantageously, this alternative embodiment may eliminate the need to replace the packer seal 300 with the bung 60 and vice versa.

Operation of the hydraulic connector 10 according to the embodiments disclosed herein will now be described. To extend the piston-rod assembly 20, so that the bung 60 and seals 130, 260 (or packer seal 300) engage the downhole tubulars 4, the pressure of the fluid in the second chamber 70 of the connector is increased by allowing flow (e.g. drilling mud) from the top-drive assembly 2 (i.e. by turning on the top-drive assembly pumps with the valve 11 open). The air in the first chamber 80 is at a pressure sufficiently high to ensure that the piston 50 abuts the cap 40. As the pressure of the drilling mud increases, the force exerted by the drilling mud on the piston 50 and cap 40 exceeds the force exerted by the air in the first chamber on the piston 50 and the air outside the hydraulic connector 10 acting on the piston-rod assembly 20. The cap 40 is then forced toward the end-cap 42 and the piston-rod assembly 20 extends. As the projected area of the cap 40 is greater than the projected area of the piston 50 and the air pressure in the first chamber 80 is only exposed to the piston 50, the piston 50 may remain abutted against cap 40. Thus, whilst the piston-rod assembly 20 is extending, the holes 120 are not exposed and drilling mud cannot flow from the top-drive 2 into the string of downhole tubulars 4. Furthermore, as the pressure of the drilling mud in the second chamber 70 exceeds the pressure of the air within the tubular rod 30, the valve 140 may also remain closed.

In an alternative method for extending the piston-rod assembly 20, the valve 11 could be closed and the second chamber 70 pressurized with air or any other fluid from the side-port 12. The first chamber 80 could be vented to a predetermined pressure to reduce the pressure required in the second chamber 70.

Once the bung 60 and seals 130, 260 are forced into the open threaded end of the upper end of the string of downhole tubulars 4, thereby forming a fluid tight seal between the piston-rod assembly 20 and the open end of the drill string 4, the piston-rod assembly 20, and hence cap 40, are no longer able to extend. In contrast, as the piston 50 is free to move on the tubular rod 30, the piston 50 is forced further along by the pressure of the drilling mud in the second chamber 70. The holes 120 are thus exposed and drilling mud is allowed to flow from the second chamber 70, through the piston-rod assembly 20 and into the string of downhole tubulars 4. With the holes 120 open, the hydraulic connector 10 will ensure that the volume displaced by the removal of the string of downhole tubulars 4 from the well is replaced by drilling mud. The pressure of the air in the first chamber 80 may then be released until retraction of the piston-rod assembly 20 is required.

The travel of the piston 50 may be limited by the first abutment shoulder 56. Thus, once the piston-rod assembly 20 has landed in the downhole tubular 4 and the pressure force acting on the piston 50 from the second chamber is sufficient to overcome the opposing pressure force from the first chamber, the piston 50 may abut the first abutment shoulder 56, and expose the holes 120. The abutment of the piston 50 against the first abutment shoulder 56 may be advantageous because it may increase the area over which the pressure in the second chamber 70 acts. Because of the first abutment shoulder 56, the pressure force acting on the piston 50 from the second chamber may contribute to the net pressure force acting on the piston-rod assembly 20. This additional pressure force may assist in maintaining the piston-rod assembly 20 in engagement with the downhole tubular 4. This may be particularly pertinent when the hydraulic connector engages with a casing section (using the packer seal 300 described above) as the cross-sectional area of the casing section may be (and typically is) greater than that of the cap 40. The pressure force acting on the packer seal 300 may therefore be likely to exceed that acting on the cap 40. However, the additional pressure force acting on the piston 50, which may be transmitted via the first abutment shoulder 56 helps to redress this balance.

If the piston-rod assembly 20 extends fully from cylinder 15 before bung 60 and seals 130 fully engage string of downhole tubulars 4, the piston 50 will be prevented from lowering further by the end-cap 42. The holes 120 will therefore be unable to open and this ensures that no drilling mud is spilt if the piston-rod assembly 20 does not fully engage a string of downhole tubulars 4.

Alternatively, if the string of downhole tubulars 4 is to be lowered into the well while attached to the hydraulic connector 10, then the string of downhole tubulars 4 will displace fluid within the well and result in a back-flow into the hydraulic connector 10 and top-drive 2. Under such circumstances, or if there is sufficient back-flow for any other reason, the valve (flapper valve 140 or poppet valve 210) may open if pressure of the fluid in the tubular rod 30 is greater than the pressure of the drilling fluid in the second chamber 70. Furthermore, as the air pressure in first chamber 80 may be reduced, the piston 50 may be in the open position permitting flow through the holes 120.

With the valve 210 open, the pressure drop across the piston-rod assembly 20 may be negligible and the piston-rod assembly 20 may remain engaged with the downhole tubulars 4. Without the valve 210, there would be a significant pressure drop across the holes 120 and there might be a resulting tendency for the piston-rod assembly 20 to withdraw from the downhole tubulars 4. The valve 210 may therefore allow the hydraulic connector 10 to be used both in lowering and removing the downhole tubulars 4.

During back-flow, when drilling fluid flows from the string of downhole tubulars 4 to the top-drive 2, the filter 200 may filter out any debris and particulate matter, thereby protecting various components of the hydraulic connector 10 and the top-drive 2. The (upward) orientation of the filter 200 encourages any debris to collect at the closed (i.e., uppermost) end of the filter. Thus, when the flow is reversed such that drilling fluid flows from the top-drive 2 to the string of downhole tubulars 4, the debris that has collected at the closed end of the filter is flushed back into the well-bore. The filter 200 may therefore exhibit a self-cleaning function as a result of its orientation. By contrast, if the filter 200 were orientated with the closed end facing the string of downhole tubulars 4, debris would collect about the flange of the filter during back-flow. Reversal of the flow (i.e., toward the string of downhole tubulars 4) would then not be as effective at removing the debris from around the flange. The accumulation of debris may result in an increase in the pressure drop across the filter.

When the piston-rod assembly 20 is to be retracted from the downhole tubulars 4, the pressure of the air in the first chamber 80 may be increased. The top-drive's fluid pumps may also be stopped to reduce the pressure of the fluid in the second chamber 70. The force exerted on the piston 50 by the fluid in the second chamber 70 may then be less than the force exerted on the piston 50 by the air in the first chamber 80 and the piston 50 may be biased towards the cap 40 and socket 90. Retraction of the piston 50, in turn, forces the retraction of the piston-rod assembly 20 into the cylinder 15. The piston 50 may also abut the cap 40, thereby closing the holes 120 and thereby limiting any spillage by ensuring no fluid (e.g. drilling mud) flows out of the hydraulic connector. Furthermore, the movement of the cap 40 may cause the valve 210 to close and the resulting increase in pressure in the second chamber 70 may ensure that the valve 210 is sealed and that no drilling mud leaks from the retracting piston-rod assembly 20. When the piston-rod assembly 20 is retracted, the bung 60 and the seals 130, 260 may be disengaged from the downhole tubulars 4. The top most section of the downhole tubulars 4 may then be removed if desired.

The valve 11 between the top-drive assembly 2 and the hydraulic connector may be closed to isolate the top-drive assembly 2 from the hydraulic connector when the piston-rod assembly 20 is to be retracted into the cylinder 15. Furthermore, the side port 12 between the valve 11 and hydraulic connector may be opened. This may reduce the hydraulic head (i.e., pressure) of the fluid acting on the cap 40 and piston 50 in the second chamber 70, thereby assisting the retraction of the piston-rod assembly 20. To further enhance this effect and remove excess fluid from the second chamber 70, suction (or vacuum) may be applied via the side port between the valve and the hydraulic connector.

As described above, the hydraulic connector 10 may replace a traditional threaded connection between a top-drive 2 and downhole tubulars 4 during tripping operations of the downhole tubulars 4 into or out of a well. With this connector (e.g., 10), the connection between the top-drive 2 and downhole tubulars 4 may be established in a much shorter time and at greater savings. Nevertheless, should it be desirable, the threaded member 110 may enable the hydraulic connector 10 to be rigidly connected to the downhole tubulars directly by means of a traditional threaded connection. In this manner, the hydraulic connector 10 may be connected to a drill string or a casing string for the transmission of torque and/or axial load. Threaded member 110 may connect to a downhole tubular of any size by using an intermediate swage.

Furthermore, in certain applications, hydraulic connector 10 may provide pressurized fluid to a bore of an expandable downhole tubular, for example an expandable casing section. The expandable downhole tubular may be expanded by virtue of the pressurized fluid acting on an inner surface of the expandable downhole tubular so as to expand the expandable downhole tubular. The piston-rod assembly 20 may be clamped in place by clamp 35 when applying such pressures to ensure that the piston-rod assembly is not forced out of the downhole tubular by the pressurized fluid in the downhole tubular. In addition, or alternatively, the first abutment shoulder 56 may assist in maintaining the piston-rod assembly 20 in engagement with the downhole tubular 4, as the pressure force acting on the piston 50 from the second chamber may contribute through the first abutment shoulder 56 to the net pressure force acting on the piston-rod assembly 20.

Advantageously, bung 60 and packer seal 300 may be used in a range of situations. In particular, by interchanging the bung 60 with the packer seal 300, the same hydraulic connector may be used to connect to a drill-string and/or a casing-string. Furthermore, the hydraulic connector 10 may also be used to connect to other tools, for example, a cementing tool. The hydraulic connector 10 may also be permanently connected to the top-drive assembly 2 and may be used to establish a connection when running (i.e., lowering) casing sections, when running casing sections hung on a drill pipe (e.g., in deep sea applications), when cementing a casing string in place; and when running and tripping out (i.e. raising) drill pipe sections for drilling. Exemplary methods for each of these situations are summarized below. While the methods described below are exemplary, they should not be considered limiting on the scope of the claims attached hereto. Those having ordinary skill in the art will appreciate that numerous alternative methods may be employed without departing from the scope of the claims appended hereto.

Lowering Casing Sections:

Initially the piston-rod assembly 20 may be retracted, the packer seal 300 may be fitted to tubular rod 30 and the clamp 35 may be fitted to allow for flow back when piston-rod assembly 20 is retracted. Casing elevators 8 clamp topmost casing section.

Lower stinger shaft to engage casing section by either closing valve 11, pressurizing second chamber 70 with air from side port 12, allowing first chamber 80 to vent to a predetermined pressure if necessary or closing valve 13 to side port 12, maintaining pressure in the first chamber 80 with a constant supply at a predetermined air pressure, opening valve 11 and turning on the top-drive assembly pumps to commence circulation and increase pressure in the second chamber 70.

Piston-rod assembly 20 extends and the packer seal 300 grips the inside of a casing section to attain hydraulic integrity.

Alternatively, the piston-rod assembly 20 may be clamped in a retracted position by clamp 35 or the packer seal 300 may be threadably attached to the threaded member 110. Furthermore, the packer seal 300 may be omitted altogether with the hydraulic connector threadably connected to the casing by virtue of a swage. With any of these arrangements, the top-drive assembly may be lowered to engage the casing section.

Pick up the casing string with the elevators 8 and release slips (not shown) which had been holding the casing string in place.

Lower the top-drive assembly 2 and the casing string into the well.

Receive backflow of drilling fluid as casing string lowered by either closing valve 11, releasing the pressure in first chamber 80 to a predetermined value, opening valve 13 (valve 210 may automatically open due to the higher pressure in the casing), receiving backflow through side port 12 and optionally sending this backflow downhole, or closing valve 13 (if not already closed), opening valve 11 (if not already open), releasing the pressure in first chamber 80 to a predetermined value (valve 210 may automatically open due to the higher pressure in the casing), receiving backflow through top-drive assembly 2 and optionally sending this backflow downhole.

If, the piston-rod assembly 20 is clamped by clamp 35, the packer seal 300 is threadably attached to the threaded member 110, or the hydraulic connector is connected to the casing by a swage, then it is not necessary to release the pressure in first chamber 80 to a predetermined value.

Re-engage slips once the casing string has been lowered by a section length.

Retract the piston-rod assembly 20 from the casing section by either closing valve 13 (if not already closed), opening valve 11 (if not already open), turning off top-drive assembly pumps to decrease mud pressure in second chamber 70 and pressurizing the first chamber 80 with air, or closing valve 11 (if not already closed), opening valve 13 (if not already open) and pressurizing the first chamber 80 with air.

Piston-rod assembly 20 retracts and the packer seal 300 is released from the casing section.

If the piston-rod assembly 20 is clamped by clamp 35 or the packer seal 300 is threadably attached to the threaded member 110 then release the packer seal 300 by raising the top-drive assembly. If the hydraulic connector is connected to the casing by a swage, then release the swage and raise the top-drive assembly.

Release the casing elevators 8, raise the top-drive assembly 2 and add another casing section.

Repeat as above until required length of casing has been lowered into the well.

Lowering Casing String Hung on Drill Pipe:

Initially the required length of casing string is held in slips and a drill pipe section is attached to the casing string with a liner hangar type of adapter.

The packer seal 300 is removed and the bung 60 is instead connected to the piston-rod assembly 20.

Drill pipe elevators 8 clamp topmost drill pipe section.

Method same as for lowering casing string described above except that the bung 60 engages the inside of successive drill pipes 4.

Repeat until casing string reaches required depth.

Cementing:

Initially a cementing tool is threadably attached to the threaded member 110 of the connector or alternatively to the first end 32 of the tubular rod 30. The clamp 35 may be fitted to hold the piston-rod assembly 20 in place.

Engage the cementing tool with the topmost section of the drill pipe.

Close valve 11 during cementing.

Pump the required amount of cement via the cementing tool down inside the drill pipe and casing string with plugs either side of the cement.

Open valve 11 and pump drilling mud from the top-drive assembly 2 to chase the plugs and force the cement round the casing shoe into the annular space between the borehole and the outside of the casing string. Allow cement to set.

Disengage drill pipe from the casing once cement has set.

Remove the cementing tool from the connector.

Connect the bung 60 to the piston-rod assembly 20.

Raise the drill pipe (see method below).

Make up new drill out assembly.

Drill through remaining cement plugs, floats and casing shoe.

Lowering (and Raising) a Drill Pipe for Drilling Operations:

Initially, a drilling tool is attached to the lowermost drill pipe section. The method for lowering the drill pipe is then substantially the same as for lowering casing sections (see above), but is nevertheless described below for sake of completeness.

Drill pipe elevators 8 clamp topmost drill pipe section.

Lower the piston-rod assembly 20 to engage the topmost drill pipe section when the drill pipe open end is at the top of the derrick by turning on the pumps in the top-drive assembly 2 to increase pressure in the second chamber 70 and venting the first chamber 80 to a predetermined pressure. Bung 60 engages inside of the drill pipe.

NB, the engagement of the bung can be established by selectively connecting only one constant air feed line to the first chamber 80 and by switching the top-drive assembly pumps on or off.

Pick up the drill pipe with the elevators 8 and top-drive assembly 2.

Release the slips holding the drill pipe in place.

Lower the top-drive assembly 2 to lower the drill pipe into the well.

Re-engage slips once the drill pipe has been lowered by a drill pipe section length.

Retract the piston-rod assembly 20 when the drill pipe open end is landed in the slips at floor level by turning off the pumps in the top-drive assembly 2 to decrease pressure in the second chamber 70 and replenishing the first chamber 80 with an additional volume of air from the constant air supply.

Bung 60 released from inside of drill pipe.

Release elevators 8 and raise the top-drive assembly 2.

Add another drill pipe section.

Repeat as above until drill string reached required depth.

Remove bung 60 from the piston-rod assembly 20.

Engage topmost drill pipe with the threaded section 110 of the hydraulic connector to allow transmission of rotation from top-drive assembly 2 to drill pipe.

To remove the drill-string from the well (i.e., tripping out of hole) repeat the above process but in reverse with the exception that the bung 60 is inserted at floor level and is retracted at the top of the derrick when racking back the drill pipe.

Advantageously, a method to connect a top-drive assembly to one of a bore of a first downhole tubular and a bore of a second downhole tubular may include providing a communication tool to a distal end of the top-drive assembly. The communication tool may comprise a body assembly, an engagement assembly, a valve assembly and a seal assembly. The method may include engaging a first portion of the seal assembly in the bore of the first downhole tubular, forming a seal between the first downhole tubular and the communication tool with the first portion of the seal assembly, selectively permitting fluid to flow between the top-drive assembly and the first downhole tubular with the valve assembly, disengaging the first portion of the seal assembly from the bore of the first downhole tubular, engaging a second portion of the seal assembly into the bore of the second downhole tubular, forming a seal between the second downhole tubular and the communication tool with the second portion of the seal assembly, and selectively permitting fluid to flow between the top-drive assembly and the second downhole tubular with the valve assembly.

The method may further include one or more of engaging the seal assembly into the bore of one of the first and second downhole tubulars by lowering the top-drive assembly and engaging the seal assembly into the bore of one of the first and second downhole tubulars by operating the engagement assembly. The method may further include one or more of disengaging the seal assembly from the bore of one of the first and second downhole tubulars by raising the top-drive assembly and disengaging the seal assembly from the bore of one of the first and second downhole tubulars by operating the engagement assembly.

Advantageously, the method may further include interchanging one of the first and second portions of the seal assembly with the other of the first and second portions of the seal assembly. The method may further include connecting one or more of the first and second portions of the seal assembly to the engagement assembly of the communication tool. The method may further include connecting one or more of the first and second portions of the seal assembly to the body assembly of the communication tool. The method may further include providing a cementing tool, connecting the cementing tool to the communication tool, engaging the cementing tool with the first downhole tubular, and pumping cement into the first downhole tubular.

The method may further include connecting the cementing tool to the engagement assembly of the communication tool and engaging the first downhole tubular with the cementing tool by operating the engagement assembly. The method may further include connecting the cementing tool to the body assembly of the communication tool and engaging the first downhole tubular with the cementing tool by lowering the top-drive assembly. The method may further include detachably connecting the communication tool to a section of the first downhole tubular, lowering the top-drive assembly and the first downhole tubular, transmitting fluid between the top-drive assembly and first downhole tubular; detaching the communication tool from the first downhole tubular, raising the top-drive assembly, and installing successive additional sections of the first downhole tubular until the desired length of the first downhole tubular is obtained.

The method may further comprise pressurizing fluid provided by the communication tool to an expandable downhole tubular, for example a casing section; and expanding the expandable downhole tubular by virtue of the pressurized fluid. The engagement assembly may be clamped when applying such pressures.

The method may further include detachably connecting a lower-most section of the second downhole tubular to a top-most section of the first downhole tubular by virtue of an intermediate member, detachably sealing the second portion of the seal assembly of the communication tool to a section of the second downhole tubular, lowering the top-drive and the first and second downhole tubulars, transmitting fluid between the top-drive assembly and the first and second downhole tubulars, and installing successive additional sections of the second downhole tubular until the desired depth of the first downhole tubular is obtained.

The method may further include detachably sealing the second portion of the seal assembly of the communication tool to a section of the second downhole tubular, lowering the top-drive assembly and the second downhole tubular, transmitting fluid between the top-drive assembly and the second downhole tubular, detaching the communication tool from the second downhole tubular, raising the top-drive assembly, and installing successive additional sections of the second downhole tubular.

The method may further include detachably sealing the second portion of the seal assembly of the communication tool to a section of the second downhole tubular, raising the top-drive assembly and the second downhole tubular, transmitting fluid between the top-drive assembly and the second downhole tubular, detaching the communication tool from the second downhole tubular, removing successive sections of the second downhole tubular, and lowering the top-drive assembly. The first downhole tubular may be a casing string and the second downhole tubular may be a drill string.

Advantageously, a method to connect a fluid supply to a downhole tubular may include lowering a connector to engage the downhole tubular, engaging a sidewall of the downhole tubular with the connector such that the engagement with the sidewall activates a locking mechanism between the connector and the downhole tubular, sealing the connector to the downhole tubular, receiving backflow from the downhole tubular and through the connector as the downhole tubular is lowered into a well, and releasing the locking mechanism by raising the connector with respect to the downhole tubular.

The connector may be attached to an extendable shaft which may be adapted to selectively lower and raise the connector. The connector may comprise the seal assembly according to the fourth aspect of the present invention.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. A method to connect a lifting assembly to a bore of a downhole tubular, the method comprising:

providing a communication tool to a distal end of the lifting assembly, the communication tool comprising a body assembly, an engagement assembly, a valve assembly and a seal assembly;

sealingly engaging a first portion of the seal assembly in the bore of the downhole tubular;

selectively permitting fluid to flow between the lifting assembly and the downhole tubular with the valve assembly;

disengaging the first portion of the seal assembly from the bore of the downhole tubular;

connecting a cementing tool to the communication tool;

engaging the cementing tool with the downhole tubular; and pumping cement into the downhole tubular.

2. The method of claim 1, further comprising: removing the cementing tool;

sealingly engaging a second portion of the seal assembly into a bore of a second downhole tubular; and selectively permitting fluid to flow between the lifting assembly and the second downhole tubular with the valve assembly.

3. The method of claim 1, further comprising: removing the cementing tool;

interchanging the seal assembly with an alternative seal assembly;

sealingly engaging the alternative seal assembly into a bore of a second downhole tubular; and selectively permitting fluid to flow between the lifting assembly and the second downhole tubular with the valve assembly.

4. The method of claim 1, further comprising engaging the seal assembly into the bore of the downhole tubular by lowering the lifting assembly.

5. The method of claim 1, further comprising connecting the first portion of the seal assembly to the engagement assembly of the communication tool.

6. The method of claim 1, further comprising:

connecting the cementing tool to the engagement assembly of the communication tool; and engaging the downhole tubular with the cementing tool by operating the engagement assembly.

7. The method of claim 1, further comprising:

connecting the cementing tool to the body assembly of the communication tool; and engaging the downhole tubular with the cementing tool by lowering the lifting assembly.

8. The method of claim 1, further comprising removing the cementing tool;

connecting the communication tool to a section of the downhole tubular;

lowering the lifting assembly and the downhole tubular;

transmitting fluid between the lifting assembly and the downhole tubular; and installing successive additional sections of the downhole tubular until the desired length of the downhole tubular is obtained.

9. The method of claim 1, wherein the downhole tubular comprises at least one of a casing string and a drill string.

10. The method of claim 1, wherein the lifting assembly comprises a top-drive assembly.

11. A method to connect a lifting assembly to a bore of a downhole tubular, the method comprising:

providing a communication tool to a distal end of the lifting assembly, the communication tool comprising a body assembly, an engagement assembly, a valve assembly and a seal assembly;

sealingly engaging a first portion of the seal assembly in the bore of the downhole tubular;

selectively permitting fluid to flow between the lifting assembly and the downhole tubular with the valve assembly; and disengaging the first portion of the seal assembly from the bore of the downhole tubular;

wherein the engagement assembly comprises a clamp to restrict travel of the engagement assembly.

12. A method to connect a lifting assembly to a bore of a downhole tubular, the method comprising:

providing a communication tool to a distal end of the lifting assembly, the communication tool comprising a body assembly, an engagement assembly, a valve assembly and a seal assembly;

sealingly engaging a first portion of the seal assembly in the bore of the downhole tubular;

selectively permitting fluid to flow between the lifting assembly and the downhole tubular with the valve assembly;

disengaging the first portion of the seal assembly from the bore of the downhole tubular;

pressurizing fluid in the bore of the downhole tubular; and expanding the downhole tubular with the pressurized fluid.

13. A communication tool to interchangeably connect a lifting assembly to downhole tubulars, the communication tool comprising:

a tool body;

an engagement assembly adapted to selectively permit engagement of the communication tool with the downhole tubulars;

a valve assembly adapted to selectively permit flow between the lifting assembly and the downhole tubulars; and a seal assembly comprising;

a first portion adapted to engage a bore of a first downhole tubular; and a second portion adapted to engage a bore of a second downhole tubular;

wherein the first and second portions of the seal assembly are interchangeable.

14. The communication tool of claim 13, wherein the engagement assembly comprises a piston-rod assembly.

15. The communication tool of claim 14, wherein the piston-rod assembly is operable between an extended position and a retracted position by at least one of hydraulic power and pneumatic power.

16. The communication tool of claim 13, wherein at least one of the first and second portions of the seal assembly comprises an inflatable member.

17. The communication tool of claim 13, wherein at least one of the first and second portions of the sealing assembly comprises an expandable member.

18. The communication tool of claim 13, wherein one of the first and second portions of the seal assembly is larger in diameter than the other of the first and second portions of the seal assembly.

19. The communication tool of claim 13, wherein the first portion of the sealing assembly is integrally formed with the second portion of the sealing assembly.

20. The communication tool of claim 13, wherein the lifting assembly comprises a top-drive assembly.

21. A communication tool to interchangeably connect a lifting assembly to downhole tubulars, the communication tool comprising:

a tool body;

an engagement assembly adapted to selectively permit engagement of the communication tool with the downhole tubular, wherein the engagement assembly comprises a piston-rod assembly;

a valve assembly adapted to selectively permit flow between the lifting assembly and the downhole tubulars;

a seal assembly comprising;

a first portion adapted to engage a bore of a first downhole tubular; and a second portion adapted to engage a bore of a second downhole tubular; and a clamp to restrict displacement of the piston-rod assembly with respect to the tool body.

22. A communication tool to interchangeably connect a lifting assembly to downhole tubulars, the communication tool comprising:

a tool body;

an engagement assembly adapted to selectively permit engagement of the communication tool with the downhole tubulars;

a valve assembly adapted to selectively permit flow between the lifting assembly and the downhole tubulars;

a seal assembly comprising;

a first portion adapted to engage a bore of a first downhole tubular; and a second portion adapted to engage a bore of a second downhole tubular; and wherein the seal assembly comprises a tubular rod, a bung, and a plurality of seals.

23. The communication tool of claim 22, wherein the plurality of seals are configured to seal between the tubular rod and the bore of at least one of the first and second downhole tubulars.

24. The communication tool of claim 22, wherein the plurality of seals comprises cup seals.

25. The communication tool of claim 22, wherein at least one of the bung and the plurality of seals is replaceable to accommodate a variety of downhole tubular sizes and configurations.

26. The communication tool of claim 22, wherein fluids from the lifting assembly enter one of the first and second downhole tubulars through a bore of the tubular rod.

27. A communication tool to interchangeably connect a lifting assembly to downhole tubulars, the communication tool comprising:

a tool body;

an engagement assembly adapted to selectively permit engagement of the communication tool with the downhole tubulars;

a valve assembly adapted to selectively permit flow between the lifting assembly and the downhole tubulars;

a seal assembly comprising;

a first portion adapted to engage a bore of a first downhole tubular; and a second portion adapted to engage a bore of a second downhole tubular;

wherein the first portion of the sealing assembly is separable from the second portion of the sealing assembly.

28. A communication tool to interchangeably connect a lifting assembly to downhole tubulars, the communication tool comprising:

a tool body;

an engagement assembly adapted to selectively permit engagement of the communication tool with the downhole tubulars;

a valve assembly adapted to selectively permit flow between the lifting assembly and the downhole tubulars;

a seal assembly comprising;

a first portion adapted to engage a bore of a first downhole tubular; and a second portion adapted to engage a bore of a second downhole tubular;

wherein the first portion of the seal assembly comprises:

a connector body including a first surface inclined with respect to an axis of the first downhole tubular;

a seal member to seal between the connector body and the first downhole tubular; and a locking element slidably disposed about the connector body, the locking element comprising a second inclined surface for cooperation with the first surface of the connector body.

* * * * *